US012492479B2

(12) United States Patent
Li et al.

(10) Patent No.: US 12,492,479 B2
(45) Date of Patent: Dec. 9, 2025

(54) ETCHING DEVICE

(71) Applicant: CONTEMPORARY AMPEREX TECHNOLOGY (HONG KONG) LIMITED, Hong Kong (CN)

(72) Inventors: Keqiang Li, Ningde (CN); Xiaosong Liu, Ningde (CN); Zhiyang Wu, Ningde (CN); Yi Lu, Ningde (CN)

(73) Assignee: CONTEMPORARY AMPEREX TECHNOLOGY (HONG KONG) LIMITED, Hong Kong (CN)

( * ) Notice: Subject to any disclaimer, the term of this patent is extended or adjusted under 35 U.S.C. 154(b) by 1 day.

(21) Appl. No.: 18/676,513

(22) Filed: May 29, 2024

(65) Prior Publication Data

US 2024/0309515 A1 Sep. 19, 2024

Related U.S. Application Data

(63) Continuation of application No. PCT/CN2023/070647, filed on Jan. 5, 2023.

(30) Foreign Application Priority Data

Jan. 13, 2022 (CN) ..... 202210035323.9

(51) Int. Cl.
*C23F 1/08* (2006.01)
*C23F 1/02* (2006.01)

(52) U.S. Cl.
CPC . *C23F 1/08* (2013.01); *C23F 1/02* (2013.01)

(58) Field of Classification Search
USPC ..... 118/718; 156/345.2, 345.19
See application file for complete search history.

(56) References Cited

U.S. PATENT DOCUMENTS 4,398,994 A * 8/1983 Beckett ..... B41M 3/00 216/102
6,193,897 B1 2/2001 Nikaido et al.
(Continued)

FOREIGN PATENT DOCUMENTS

CN 101351572 A 1/2009
CN 102751185 A 10/2012
(Continued)

OTHER PUBLICATIONS

International Search Report received in the corresponding international application PCT/CN2023/070647, mailed on Mar. 13, 2023.
(Continued)

*Primary Examiner* — Ram N Kackar
(74) *Attorney, Agent, or Firm* — K&L Gates LLP

(57) ABSTRACT

Provided an etching device that is capable of effectively realizing an opening structure with low cost and simplified process. The etching device includes: a porous roller, the porous roller being a hollow structure with openings at both ends, an etching liquid being accommodated in the hollow structure, and the porous roller being provided with a plurality of openings; a pressing roller, attached to the porous roller and arranged above the liquid level of the etching liquid, for pressing and attaching a metal layer to be etched onto the surface of the porous roller; wherein during rotation of the porous roller, the etching liquid passes through at least part of the openings of the plurality of openings and continuously soaks the metal layer in contact with the at least part of the openings, so as to continuously etch the metal layer in contact with the at least part of the openings.

13 Claims, 2 Drawing Sheets

(56) References Cited

U.S. PATENT DOCUMENTS

| | | | | |
|---|---|---|---|---|
| 7,763,114 | B2 * | 7/2010 | Tokie | C23C 16/545 118/301 |
| 2008/0099144 | A1 * | 5/2008 | Change | H01L 21/31111 156/345.11 |
| 2012/0175343 | A1 | 7/2012 | Gieker | |

FOREIGN PATENT DOCUMENTS

| | | | | |
|---|---|---|---|---|
| CN | 105200425 | A | 12/2015 | |
| CN | 105200425 | B | 5/2018 | |
| CN | 109778188 | A | 5/2019 | |
| CN | 110894606 | A | 3/2020 | |
| CN | 110951104 | A | 4/2020 | |
| JP | 59006372 | * | 1/1984 | C23C 14/042 |
| JP | 1996111174 | A | 4/1996 | |
| JP | 2012180583 | A | 9/2012 | |
| KR | 20020038334 | A | 5/2002 | |
| KR | 101185315 | B1 | 9/2012 | |
| KR | 20140055465 | A | 5/2014 | |
| KR | 101471096 | B1 | 12/2014 | |
| KR | 20180026917 | A | 3/2018 | |

OTHER PUBLICATIONS

Written Opinion received in the corresponding international application PCT/CN2023/070647, mailed on Mar. 13, 2023.

Request for the Submission of an Opinion received in the corresponding Korean application 10-2024-7010683, mailed on Apr. 29, 2024.

The extended European search report received in the counterpart European Application 23739876.3, mailed on Nov. 28, 2024.

The Notice of Reasons for Refusal received in the counterpart Japanese Application 2024-517468, mailed on Oct. 28, 2024.

The Written Decision on Registration received in the counterpart Korean Application 10-2024-7010683, mailed on Nov. 6, 2024.

Notice of Allowance (with English Machine Translation), mailed Jul. 9, 2025, for corresponding Chinese Patent Application Serial No. 202210035323.9.

* cited by examiner

ETCHING DEVICE

CROSS-REFERENCE TO RELATED APPLICATION

The present application is continuation of International Application No. PCT/CN2023/070647, filed on Jan. 5, 2023, which claims priority to Chinese patent application 202210035323.9 filed on Jan. 13, 2022 and entitled "ETCHING DEVICE", which is incorporated herein by reference in its entirety.

TECHNICAL FIELD

The present application relates to the field of etching technologies, and in particular to an etching device.

BACKGROUND

Energy conservation and emission reduction are the key to the sustainable development of the automobile industry. In this case, due to the advantages of energy conservation and environment protection, electric vehicles have become an important part of the sustainable development of the automobile industry. For electric vehicles, battery technology is an important factor related to their development.

In order to improve the performance of the battery, a current collector is usually drilled. At present, a drilling process of the current collector usually consists of coating, exposure, development, etching, and other steps. However, the drilling process is not only complex but also costly. For example, a photosensitive material coated on a surface of the current collector in the coating step is usually expensive.

SUMMARY OF THE INVENTION

Embodiments of the present application provide an etching device that is capable of effectively realizing an opening structure with low cost and simplified process.

In a first aspect, an etching device is provided, including: a porous roller, the porous roller being a hollow structure with openings at both ends, an etching liquid being accommodated in the hollow structure, and the porous roller being provided with a plurality of openings; a pressing roller, attached to the porous roller and arranged above the liquid level of the etching liquid, for pressing and attaching a metal layer to be etched onto the surface of the porous roller; wherein during rotation of the porous roller, the etching liquid passes through at least part of the openings of the plurality of openings and continuously soaks the metal layer in contact with the at least part of the openings, so as to continuously etch the metal layer in contact with the at least part of the openings.

In the embodiment of the present application, the porous roller is arranged, and the porous roller is provided with the plurality of openings and accommodates the etching liquid therein. In this way, during the rotation of the porous roller, the etching liquid can continuously etch the metal layer in contact with the openings through the openings of the porous roller, not only the purpose of opening holes in the metal layer is achieved, but also the requirement on an etching thickness is met because the etching liquid continuously etches the metal layer, so that the contact time between the etching liquid and the metal layer is lengthened, and the metal layer is capable of being etched more fully.

Furthermore, by arranging the pressing roller attached to the porous roller, in this way, during the rotation of the porous roller, a contact pressure between the metal layer and the porous roller is capable of being ensured, so that the metal layer rotates close to the porous roller, and therefore the etching liquid is capable of etching the metal layer more fully. In addition, arranging the pressing roller above the liquid level of the etching liquid, on the one hand, increases the time for the etching liquid to etch the metal layer; and on the other hand, the metal layer is already in contact with the porous roller before the metal layer continuously contacts with the etching liquid, which not only avoids the problem of liquid leakage as much as possible, but also avoids the problem of the etching liquid etching a non-opening region of the metal layer due to liquid leakage.

In some possible embodiments, the pressing roller is arranged above the axis of the porous roller.

According to the above technical solution, the pressing roller is arranged above the axis of the porous roller, which can increase a wrap angle of the porous roller to increase the etching time of the metal layer by the etching liquid, thereby being capable of etching the metal layer more fully and further meeting the requirement of the etching thickness.

In some possible embodiments, the quantity of the pressing rollers is two, and the two pressing rollers are respectively arranged upstream and downstream in a conveying direction of the metal layer of the porous roller. Starting from the pressing roller arranged upstream in the conveying direction to the pressing roller arranged downstream in the conveying direction, the etching liquid continuously etches the metal layer in contact with at least part of the openings.

In the above technical solution, the quantity of the pressing rollers is two, and the two pressing rollers are respectively arranged upstream and downstream of the porous roller in the conveying direction, so that the pressing rollers can increase contact pressures between the metal layer and the porous roller at both upstream and downstream of the porous roller, such that the metal layer can rotate closer to the porous roller. In addition, liquid leakage problems at upstream and downstream of the porous roller are avoided, thereby further improving the performance of the etching device.

In some possible embodiments, a liquid collecting apparatus is further included, at least part of the porous roller is arranged in the liquid collecting apparatus, wherein the liquid collecting apparatus is used for collecting the etching liquid leaked from the porous roller.

According to the above technical solution, the etching device includes the liquid collecting apparatus, and in this way, if the etching liquid leaks from the porous roller, the liquid collecting apparatus is capable of collecting the leaked etching liquid, thereby effectively avoiding problems of turbulent flow of the etching liquid and contamination of other apparatuses.

In some possible embodiments, a cleaning apparatus is further included, which is arranged downstream in the conveying direction of the metal layer of the porous roller, and used for cleaning the residual etching liquid on the metal layer after the etching liquid continuously etches the metal layer.

In the above technical solution, the cleaning apparatus is arranged in the etching device. After the etching liquid etches the metal layer, the metal layer is capable of being quickly cleaned to remove the residual etching liquid and other pollutants on the metal layer, so that the etching device outputs a metal layer that is capable of being directly used.

In some possible embodiments, a drying apparatus is further included, which is arranged downstream in the conveying direction of the metal layer of the cleaning apparatus, and used for drying the metal layer after the cleaning apparatus cleans the residual etching liquid on the metal layer.

In the above technical solution, by arranging the drying apparatus in the etching device, after the cleaning apparatus cleans the residual etching liquid on the metal layer, the drying apparatus is capable of quickly drying the metal layer, and the etching device does not need to stay for a period of time to wait for the metal layer to dry naturally, thereby increasing the processing speed of the entire device.

In some possible embodiments, a liquid introducing apparatus is further included, which is used for introducing the etching liquid into the hollow structure through at least one opening of the openings at both ends of the porous roller.

In some possible embodiments, a conveying roller is further included, which is used for conveying the metal layer to the porous roller and the pressing roller in the conveying direction of the metal layer, and conveying the metal layer away from the porous roller and the pressing roller after the etching liquid continuously etches the metal layer.

In some possible embodiments, the etching liquid continuously etches the metal layer to form a plurality of openings on the surface of the metal layer, and the proportion of openings formed on the surface of the metal layer is 30% to 50%.

In the above technical solution, the porosity of the metal layer is set to 30% to 50%, which is capable of meeting requirements of most current collectors, thereby effectively improving the applicability of the etching device and the current collectors.

In some possible embodiments, the etching device is used for preparing openings on a current collector, and the metal layer is a metal layer on the current collector and is arranged on a surface of a base film included in the current collector, wherein the size and shape of each of the plurality of openings on the porous roller are the same as the size and shape of the openings on the current collector.

In the above technical solution, the openings on the current collector obtained by the etching device are the same as the required openings, which improves the accuracy of the entire process.

DESCRIPTION OF DRAWINGS

In order to illustrate the technical solutions of the embodiments of the present application more clearly, the drawings required in the embodiments of the present application will be briefly introduced below. Obviously, the drawings described below represent only some embodiments of the present application. For those of ordinary skill in the art, other drawings can also be obtained according to the drawings without any creative effort.

Figure 1:
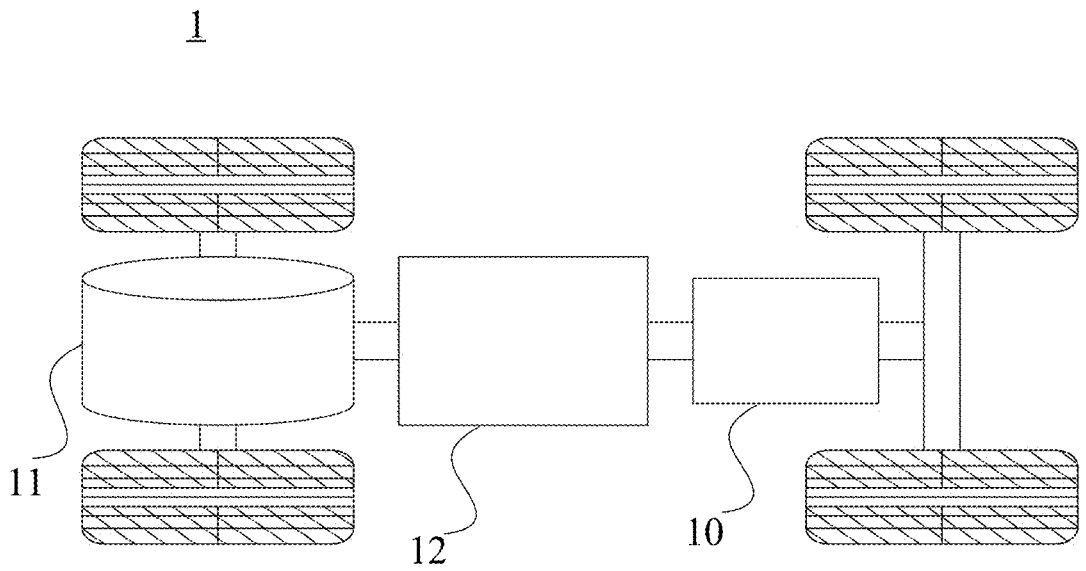
FIG. 1 is a schematic structural diagram of a vehicle disclosed in an embodiment of the present application.

In the drawings, the figures are not drawn to the actual scale.

DETAILED DESCRIPTION

The embodiments of the present application are further described in detail below with reference to the accompanying drawings. The following detailed description of the embodiments and the drawings are used to illustrate the principles of the present application by way of example, but should not be used to limit the scope of the present application, that is, the present application is not limited to the described embodiments.

In the description of the present application, it should be noted that, unless otherwise stated, "plurality of" means two or more; the orientation or positional relationships indicated by the terms "upper," "lower," "left," "right," "inner," and "outer" are only for facilitating the description of the present application and simplifying the description, rather than indicating or implying that the apparatus or element referred to must have a particular orientation or be constructed and operated in a particular orientation, and therefore will not be interpreted as limiting the present application. In addition, the terms "first," "second," and "third" are only used for descriptive purposes, and cannot be construed as indicating or implying relative importance. "Vertical" does not mean being vertical in the strict sense, but within the permissible range of error. "Parallel" does not mean being parallel in the strict sense, but within the permissible range of error.

Orientation words appearing in the following description are all directions shown in the drawings, and do not limit the specific structure of the present application. In the description of the present application, it should also be noted that, unless otherwise expressly specified and defined, the terms "install," "connected," and "connect" should be understood in a broad sense, for example, it may be a fixed connection, a detachable connection, or an integral connection; and it may be a direct connection or indirect connection through an intermediate medium. For those of ordinary skill in the art, the specific meanings of the above terms in the present application may be understood according to specific circumstances.

In the present application, the term "and/or" only describes an association relationship between associated objects and represents that three relationships may exist. For example, A and/or B may represent three situations: only A exists, both A and B exist, and only B exists. In addition, the character "/" in the present application generally means that the associated objects before and after it are in an "or" relationship.

Unless otherwise defined, all technical and scientific terms used in the present application have the same meanings as commonly understood by those skilled in the art of the present application. The terms used in the specification of the present application are only for the purpose of describing specific embodiments, but are not intended to limit the present application. The terms "include/comprise" and "have" and any variations thereof in the specification and claims of the present application and in the description of drawings above are intended to cover non-exclusive inclusion. The terms "first," "second," and the like in the specification and claims of the present application or the above drawings are used to distinguish different objects, rather than used to describe specific orders or primary and secondary relationships.

The reference to "embodiment" in the present application means that specific features, structures, or characteristics described with reference to the embodiment may be included in at least one embodiment of the present application. The appearance of the phrase in various places in the specification does not necessarily refer to the same embodiment, nor is it a separate or alternative embodiment that is mutually exclusive with other embodiments. It is understood explicitly and implicitly by those skilled in the art that the embodiments described in the present application may be combined with other embodiments.

Although the present application has been described with reference to the preferred embodiments, various improvements can be made thereto and components thereof can be replaced with equivalents without departing from the scope of the present application. In particular, the technical features mentioned in the various embodiments can be combined in any manner as long as there is no structural conflict. The present application is not limited to the specific embodiments disclosed herein, but rather includes all technical solutions falling within the scope of the claims.

In recent years, batteries, as a major power device, have been widely used in electric vehicles, military devices, aerospace, and other fields.

For example, FIG. 1 shows a schematic structural diagram of a vehicle 1 according to an embodiment of the application. The vehicle 1 may be a fuel vehicle, a gas vehicle, or a new energy vehicle, and the new energy vehicle may be an all-electric vehicle, a hybrid electric vehicle, an extended range electric vehicle, or the like. The interior of the vehicle 1 may be provided with a motor 40, a controller 30, and a battery 10, and the controller 30 is used for controlling the battery 10 to power the motor 40. As an example, the battery 10 may be arranged at the bottom or the head or the tail of the vehicle 1. The battery 10 may be used for supplying power to the vehicle 1. As an example, the battery 10 may be used as an operating power source of the vehicle 1, which is used for a circuit system of the vehicle 1, for example, for operation power requirements of the vehicle 1 during starting, navigation, and running. In another embodiment of the present application, the battery 10 can not only be used as the operating power source of the vehicle 1, but also as a driving power source of the vehicle 1 to provide driving power for the vehicle 1 instead of or partially instead of fuel or natural gas.

In the embodiments of the present application, the battery refers to a physical module including one or more battery cells to provide electric energy. For example, the battery mentioned in the present application may include a battery module, a battery pack, or the like. The battery generally includes a box body for encapsulating one or more battery cells. The box body can prevent liquids or other foreign matters from affecting the charging or discharging of the battery cells.

In the present application, the battery cell may include a lithium-ion secondary battery, a lithium-ion primary battery, a lithium-sulfur battery, a sodium-lithium-ion battery, a sodium-ion battery, a magnesium-ion battery, or the like, which will not be limited in the embodiments of the present application. Generally, a battery cell may also be called a cell core.

The battery cell includes an electrode assembly and an electrolyte solution, and the electrode assembly is composed of a positive electrode plate, a negative electrode plate, and a separator. The battery cell operates mainly relying on movement of metal ions between the positive electrode plate and the negative electrode plate. The positive electrode plate includes a positive electrode current collector and a positive electrode active material layer. The positive electrode active material layer is coated on the surface of the positive electrode current collector, the part of the positive electrode current collector not coated with the positive electrode active material layer protrudes from the part of the positive electrode current collector already coated with the positive electrode active material layer, and the part of the positive electrode current collector not coated with the positive electrode active material layer serves as a positive tab. Taking a lithium-ion battery as an example, the material of the positive electrode current collector may be aluminum, and the positive electrode active material may be lithium cobaltate, lithium iron phosphate, ternary lithium, lithium manganate, or the like. The negative electrode plate includes a negative electrode current collector and a negative electrode active material layer. The negative electrode active material layer is coated on the surface of the negative electrode current collector, the part of the negative electrode current collector not coated with the negative electrode active material layer protrudes from the part of the negative electrode current collector already coated with the negative electrode active material layer, and the part of the negative electrode current collector not coated with the negative electrode active material layer serves as a negative tab. The material of the negative electrode current collector may be copper, and the negative electrode active material may be carbon, silicon, or the like. In order to ensure that no fusing occurs when a large current passes, there are a plurality of positive tabs which are stacked together, and there are a plurality of negative tabs which are stacked together. The material of the separator may be polypropylene (PP), polyethylene (PE) or the like.

In order to improve the performance of the battery, a current collector is usually drilled. In a first aspect, a porous structure increases an area on the surface of the current collector that accommodates active materials, and more active materials is capable of being filled in pores, which is beneficial to improving the energy density of the battery. In a second aspect, the porous structure is capable of increasing the bonding force between the current collector and the active material. In a third aspect, the porous structure itself is conducive to infiltration of the electrolyte solution, which can increase the speed of a liquid injection process during battery processing. After the battery is processed, the sufficient infiltration of the electrolyte solution can accelerate the passage rate of lithium ions, thereby further improving the rate performance of lithium batteries. In a fourth aspect, after drilling, the migration and diffusion of lithium ions changes from the traditional two-dimensional direction to omnidirectional penetration, and a contact surface between the active material entering a pore member and the current collector (such as the positive electrode active material and the positive electrode current collector) increases, thereby reducing the migration radius of lithium ions and effectively improving the rate performance of lithium-ion batteries.

At present, a drilling process of the current collector usually consists of coating, exposure, development, etching, and other steps. Specifically, first, a photosensitive material, such as ink, is coated on the surface of the current collector. The ink is mainly composed of photosensitive acrylate, mineral pigment particles, and a leveling agent. The acrylate is cured by an ultra-violet ray (UV) lamp and is not corrosive in acid. Next, the current collector coated with the photosensitive material is regionally cured by an exposure source, such as the UV. After that, the current collector enters a developing tank, so that the photosensitive material in an uncured region on the surface of the current collector is reacted, so that the photosensitive material is removed. At the same time, the photosensitive material in a cured region will not be removed. Afterwards, the etching solution is sprayed on the surface of the current collector to etch the uncured region on the surface of the current collector, while the cured region will not be etched due to the photosensitive material on the surface. In this way, openings are formed on the surface of the current collector.

As can be seen from the above process, at least four steps are required to form openings on the surface of the current collector, so that the entire process is more complicated. In addition, the cost of the above drilling solution is also high. For example, ink costs 3.5 yuan per square meter.

In view of this, the embodiments of the present application provide an etching device that is capable of effectively realizing an opening structure with low cost and simplified process.

It should be understood that the embodiments of the present application are described by taking the etching device used for preparing openings on the current collector as an example, but the embodiments of the present application are not limited thereto. For example, the etching device of the embodiments of the present application can also be used for etching decorative designs, patterns, and the like on packaging bags and product bags.

Figure 2:
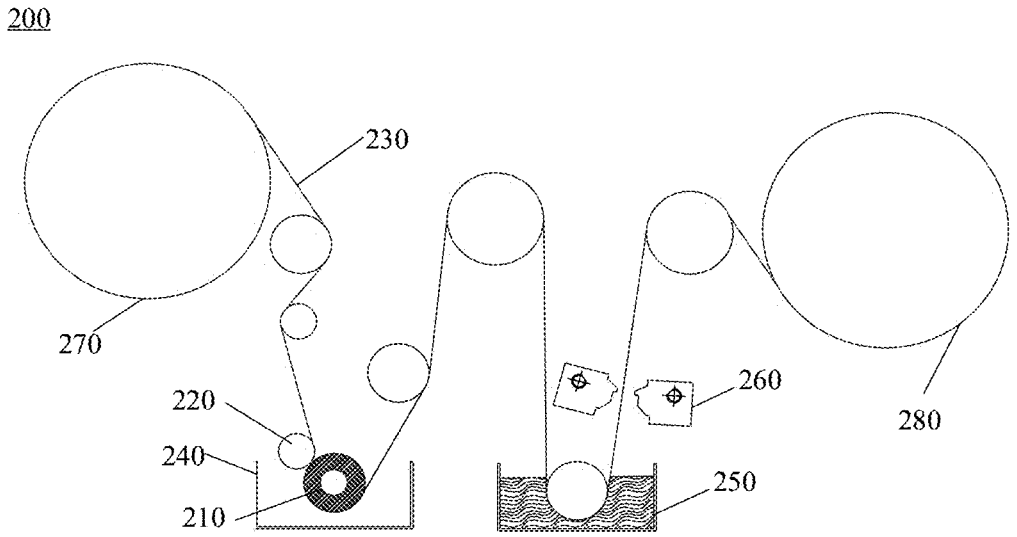
FIG. 2 is a schematic structural diagram of an etching device according to an embodiment of the present application.
Figure 3:
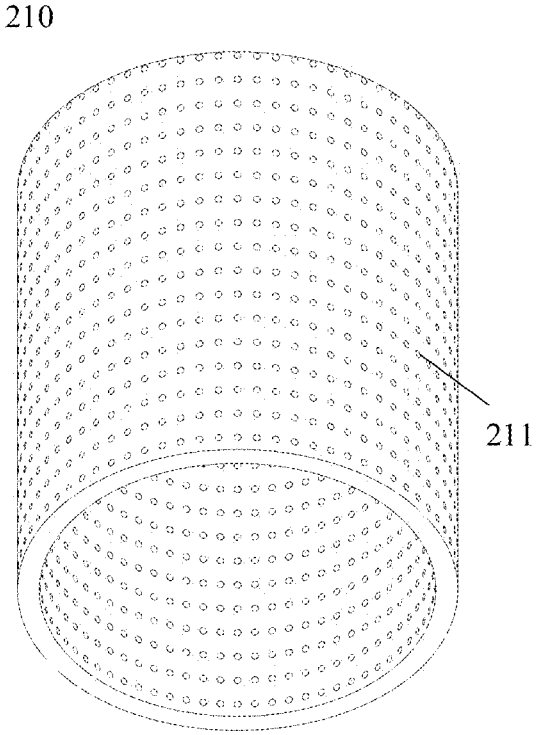
FIG. 3 is a schematic diagram of a porous roller according to an embodiment of the present application.

FIG. 2 is a schematic structural diagram of an etching device 200 according to an embodiment of the present application. As shown in FIG. 2, the etching device 200 may include a porous roller 210 and a pressing roller 220. As shown in FIG. 3, the porous roller 210 is a hollow structure with openings at both ends, and an etching liquid is accommodated in the hollow structure. The porous roller 210 is provided with a plurality of openings 211. The pressing roller 220 is attached to the porous roller 210 and is arranged above the liquid level of the etching liquid, and is used for pressing and attaching a metal layer 230 to be etched onto the surface of the porous roller 210.

During the rotation of the porous roller 210, the etching liquid passes through at least part of the openings 211 of the plurality of openings 211 to continuously soak the metal layer 230 in contact with the at least part of the openings 211, so as to continuously etch the metal layer 230 in contact with the at least part of the openings 211.

In the embodiment of the present application, the porous roller 210 is arranged, and the porous roller 210 is provided with the plurality of openings 211 and accommodates the etching liquid therein. In this way, during the rotation of the porous roller 210, the etching liquid can continuously etch the metal layer 230 in contact with the openings 211 through the openings 211 of the porous roller 210, not only the purpose of opening holes in the metal layer 230 is achieved, but also the requirement on an etching thickness is met because the etching liquid continuously etches the metal layer 230, so that the contact time between the etching liquid and the metal layer 230 is lengthened, and the metal layer 230 is capable of being etched more fully.

Furthermore, by arranging the pressing roller 220 attached to the porous roller 210, in this way, during the rotation of the porous roller 210, a contact pressure between the metal layer 230 and the porous roller 210 is capable of being ensured, so that the metal layer 230 rotates close to the porous roller 210, and therefore the etching liquid is capable of etching the metal layer 230 more fully. In addition, arranging the pressing roller 220 above the liquid level of the etching liquid, on the one hand, increases the time for the etching liquid to etch the metal layer 230; and on the other hand, the metal layer 230 is already in contact with the porous roller 210 before the metal layer 230 continuously contacts with the etching liquid, which not only avoids the problem of liquid leakage as much as possible, but also avoids the problem of the etching liquid etching a non-opening region of the metal layer 230 due to liquid leakage.

As can be seen from FIG. 2, the etching device 200 in the embodiment of the present application may be a roll-to-roll etching device. As an example, the etching time of the etching device 200 may be 30 s, the tape transport speed may be 1 meter per minute to 5 meters per minute (1 m/min to 5 m/min), the etching depth may be 50 μm to 100 μm, and the etching accuracy may be less than or equal to 5 μm.

It should be understood that the specific examples herein are intended only to assist those skilled in the art to better understand the embodiments of the present application and are not intended to limit the scope of the embodiments of the present application. For example, the etching time, tape transport speed, etching depth, and the like of the etching device 200 may be specifically set according to actual applications.

Alternatively, the etching liquid may include, but is not limited to, an acidic corrosive solution, an alkaline corrosive solution, and the like. For example, the etching liquid may be acidic copper chloride or ammonium persulfate.

Alternatively, the etching liquid accommodated in the porous roller 210 may fill the porous roller 210, or the amount of the etching liquid in the porous roller 210 may be smaller than the volume of the porous roller 210.

It should be understood that the size of the porous roller 210 and the size and shape of each opening 211 of the plurality of openings 211 on the porous roller 210 are not specifically limited in the embodiment of the present application. For example, the shape of the plurality of openings 211 on the porous roller 210 may be circular, elliptical, quadrilateral, irregular, or the like.

In some embodiments, the size and shape of each opening 211 in the plurality of openings 211 on the porous roller 210 may be the same as the size and shape of the openings on the prepared current collector. In this way, the openings on the current collector obtained by the etching device 200 are the same as the required openings, which improves the accuracy of the entire process.

Alternatively, considering that after the etching liquid continuously soaks the metal layer 230 through at least part of the openings 211 on the porous roller 210, the etching liquid has the possibility of diffusion, and therefore, the size of each opening 211 of the plurality of openings 211 on the porous roller 210 may be slightly smaller than the size of the openings on the current collector.

The etching liquid continuously etches the metal layer 230, thereby forming a plurality of openings on the surface of the metal layer 230. The proportion of the openings formed on the surface of the metal layer 230 is not specifically limited in the embodiments of the present application, and may be set specifically according to actual applications. For example, the proportion of the openings formed on the surface of the metal layer 230 may be 30% to 50%, that is, the metal layer 230 may have the porosity of 30% to 50%. The porosity of the metal layer 230 is set to 30% to 50%, which is capable of meeting requirements of most current collectors, thereby effectively improving the applicability of the etching device 200 and the current collectors.

Alternatively, the metal layer 230 may be a metal layer on a conventional current collector. For example, if the traditional current collector is a positive electrode current collector, the metal layer 230 may be aluminum foil. For example, if the traditional current collector is a negative electrode current collector, the metal layer 230 may be copper foil.

Considering that high energy density, lightweight, and flexibility of batteries are increasingly becoming people's goals, the density of copper is 8.9 g/cm3 and the density of aluminum is 2.79 g/cm$^3$, the total mass of the positive and negative electrode current collectors accounts for about 14% to 18% of the total mass of the battery, and therefore, it cannot meet the pursuit of high energy density and light-weight of batteries.

Based on this, the metal layer 230 in the embodiment of the present application may be a metal layer on a composite current collector. A middle layer of the composite current collector may be a plastic film, and an upper surface and a lower surface of the plastic film are respectively coated with metal layers 230, thereby being capable of improving light-weight and energy density of batteries. The plastic film may be oriented polypropylene (OPP) plastic, polyimide (PI) plastic, polyethylene glycol terephthalate (PET) plastic, cast polypropylene (CPP) plastic, or polyvinyl chloride (PVC) plastic, as well as one or more of their derivatives, cross-linked products, and copolymers.

It should be noted that compared with other plastic films, PET has higher thermal stability.

Figure 4:
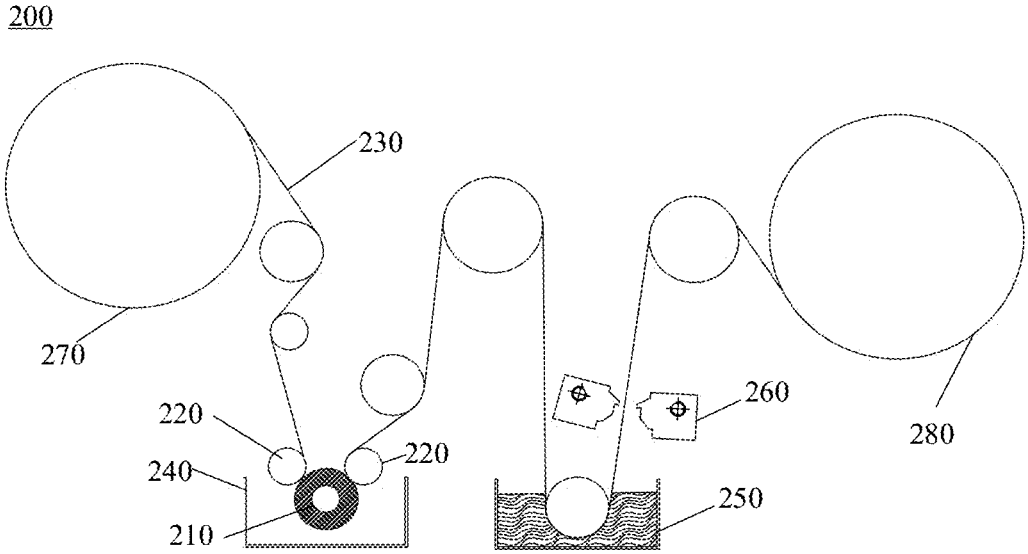
FIG. 4 is a schematic structural diagram of another etching device according to an embodiment of the present application.

In some embodiments, as shown in FIG. 4, the quantity of the pressing rollers 220 may be two, and the two pressing rollers 220 are respectively arranged upstream and downstream in the conveying direction of the metal layer 230 of the porous roller 210. At this time, starting from the pressing roller 220 arranged upstream in the conveying direction to the pressing roller 220 arranged downstream in the conveying direction, the etching liquid continuously etches the metal layer 230 in contact with the at least part of the openings 211.

Alternatively, the two pressing rollers 220 may be symmetrically arranged on both sides of the porous roller 210. For example, both of the pressing rollers 220 are arranged above the liquid level of the etching liquid.

Alternatively, the two pressing rollers 220 may be asymmetrically arranged on both sides of the porous roller 210. For example, one pressing roller of the two pressing rollers 220 is arranged above the liquid level of the etching liquid, and the other pressing roller is arranged below the liquid level of the etching liquid.

It should be noted that the term "up" in the embodiments of the present application refers to a direction opposite to the gravity direction, and the term "down" refers to the gravity direction.

In this embodiment, in a cross section perpendicular to the axis of the porous roller 210, an included angle $\alpha$ between the axis of the two pressing rollers 220 and the axis of the porous roller 210 may be at least 10 degrees. That is, the two pressing rollers 220 are close together.

In the above technical solution, the quantity of the pressing rollers 220 is two, and the two pressing rollers 220 are respectively arranged upstream and downstream of the porous roller 210 in the conveying direction, so that the pressing rollers 220 can increase contact pressures between the metal layer 230 and the porous roller 210 at both upstream and downstream of the porous roller 210, such that the metal layer 230 can rotate closer to the porous roller 210. In addition, liquid leakage problems at upstream and downstream of the porous roller 210 are avoided, thereby further improving the performance of the etching device 200.

In some embodiments, the pressing roller 220 may be arranged above the axis of the porous roller 210.

For example, if the quantity of pressing rollers 220 is two, referring to FIG. 4 again, both of the two pressing rollers 220 may be arranged above the axis of the porous roller 210. Alternatively, one pressing roller of the two pressing rollers 220 may be arranged above the axis of the porous roller 210, and the other pressing roller may be arranged below the axis of the porous roller 210.

According to the technical solution, the pressing roller 220 is arranged above the axis of the porous roller 210, which can increase a wrap angle of the porous roller 210 to increase the etching time of the metal layer 230 by the etching liquid, thereby being capable of etching the metal layer 230 more fully and further meeting the requirement of the etching thickness.

The wrap angle refers to a central angle between a contact arc of a belt and a pulley. The magnitude of the wrap angle reflects the length of the contact arc between the belt and a circular surface of the pulley.

As shown in FIG. 2 and FIG. 4, in addition to the apparatuses introduced above, the etching device 200 may also include an unwinding roller 270 and a winding roller 280.

The unwinding roller 270 is arranged at the most upstream of the conveying direction, for conveying the metal layer 230 in the conveying direction. The winding roller 280 is arranged at the most downstream in the conveying direction, for collecting the etched metal layer 230.

Further, the etching device 200 may further include at least one conveying roller, and the conveying roller is used for conveying the metal layer 230 to the porous roller 210 and the pressing roller 220 in the conveying direction, and after the etching liquid continuously etches the metal layer 230, conveying the metal layer 230 from the porous roller 210 and the pressing roller 220.

If the etching device 200 includes a plurality of conveying rollers, the sizes of the plurality conveying rollers may be the same or different, which is not limited in the embodiments of the present application.

Although the etching device 200 is capable of avoiding the problem of liquid leakage as much as possible, in some cases, the liquid leakage will inevitably occur. Based on this, as shown in FIG. 2 and FIG. 4, the etching device 200 in the embodiments of the present application may further include a liquid collecting apparatus 240.

At least part of the porous roller 210 is arranged in the liquid collecting apparatus 240, and the liquid collecting apparatus 240 is used for collecting the etching liquid leaked from the porous roller 210.

Optionally, the size of the liquid collecting apparatus 240 may be larger than the size of the porous roller 210, so that on the one hand, the porous roller 210 is capable of being arranged in the liquid collecting apparatus 240, and on the other hand, the liquid collecting apparatus 240 is capable of collecting the etching liquid leaked from the porous roller 210 as much liquid as possible.

Alternatively, the liquid collecting apparatus 240 may be a liquid collecting tank.

According to the above technical solution, the etching device 200 includes the liquid collecting apparatus 240, and in this way, if the etching liquid leaks from the porous roller 210, the liquid collecting apparatus 240 is capable of collecting the leaked etching liquid, thereby effectively avoiding problems of turbulent flow of the etching liquid and contamination of other apparatuses.

After the metal layer 230 is continuously etched by the etching liquid, contaminants such as the etching liquid may be attached to the surface. Based on this, referring again to FIG. 2 and FIG. 4, the etching device 200 may further include: a cleaning apparatus 250, arranged downstream in the conveying direction of the metal layer 230 of the porous roller 210, and used for cleaning the residual etching liquid on the metal layer 230 after the etching liquid continuously etches the metal layer 230.

As an example, as shown in FIG. 2 and FIG. 4, the cleaning apparatus 250 may include a water washing tank, and a transmission roller and a cleaning liquid are arranged in the water washing tank. When the transmission roller conveys the metal layer 230, the cleaning liquid in the water washing tank can clean the etching liquid on the metal layer 230.

The liquid level of the cleaning fluid may be higher than the transmission roller, that is, the cleaning fluid submerges the transmission roller. In this way, the cleaning liquid is capable of fully cleaning the etching liquid on the metal layer 230. Of course, only a part of the structure of the transmission roller may be submerged in the cleaning liquid.

Optionally, the cleaning liquid may be clean water or other liquids that is capable of dissolving the etching liquid.

As another example, the cleaning apparatus 250 may include a spray pipe. The spray pipe accommodates a cleaning fluid, and the spray pipe is used for spraying the cleaning fluid to the etched metal layer 230.

There may be one or a plurality of spray pipes. If there are a plurality of the spray pipes, the plurality of spray pipes may be respectively arranged on both sides of the metal layer 230. For example, if the cleaning apparatus 250 includes four spray pipes, the four spray pipes may be arranged opposite each other on both sides of the metal layer 230.

Optionally, the etching device 200 may also include a control system, and the control system is used for controlling opening and closing of the spray pipe. Specifically, when the etched metal layer 230 is conveyed to the cleaning apparatus 250 or is about to be conveyed to the cleaning apparatus 250, the control system may control the spray pipe to open, so that the spray pipe can spray the cleaning liquid to the metal layer 230. At other times, the control system controls the spray pipe to be closed.

As another example, the cleaning apparatus 250 may include a water washing tank and may also include a spray pipe. In this way, the cleaning apparatus 250 is capable of more fully cleaning the residual etching liquid on the metal layer 230 in a shorter period of time, thereby effectively improving the cleaning efficiency.

In the above technical solution, the cleaning apparatus 250 is arranged in the etching device 200. After the etching liquid etches the metal layer 230, the metal layer 230 is capable of being quickly cleaned to remove the residual etching liquid and other pollutants on the metal layer 230, so that the etching device 200 outputs a metal layer 230 that is capable of being directly used.

After the cleaning apparatus 250 cleans the residual etching liquid on the metal layer 230, the embodiment of the present application may also dry the cleaned metal layer 230.

Therefore, the etching device 200 may further include a drying apparatus 260, and the drying apparatus 260 is arranged downstream of the cleaning apparatus 250 and used for drying the metal layer 230 after the cleaning apparatus 250 cleans the residual etching liquid on the metal layer 230.

Optionally, as shown in FIG. 2 and FIG. 4, the drying apparatus 260 may include an air knife, and the air knife is used for air-drying the metal layer 230 cleaned by the cleaning apparatus 250. The embodiment of the present application does not specifically limit the quantity of air knives. For example, there may be one air knife. For another example, referring again to FIG. 2 and FIG. 4, there may be a plurality of, such as two, air knives, and the plurality of air knives may be arranged both sides of the metal layer 230 at intervals in the conveying direction.

In addition to the air knife, the drying apparatus 260 may further include a heating tube (not shown in the figure). Like the air knives, the heating tubes are also arranged on both sides of the metal layer 230 at intervals in the conveying direction. Specifically, the heating tubes and the air knives are arranged at intervals from each other. One air knife may be placed between two heating tubes, and one heating tube may be placed between the two air knives.

It should be understood that the quantity and arrangement of the heating tubes and air knives in the embodiment of the present application may be set according to various factors such as the drying speed and tape transport speed required for the metal layer 230 in actual applications. For example, two heating tubes are arranged between two adjacent air knives.

Optionally, the drying apparatus 260 may include a UV lamp, and the UV lamp may emit light of a specific wavelength band to the metal layer 230 cleaned by the cleaning apparatus 250, thereby drying the cleaned metal layer 230.

In the above technical solution, by arranging the drying apparatus 260 in the etching device 200, after the cleaning apparatus 250 cleans the residual etching liquid on the metal layer 230, the drying apparatus 260 is capable of quickly drying the metal layer 230, and the etching device 200 does not need to stay for a period of time to wait for the metal layer 230 to dry naturally, thereby increasing the processing speed of the entire device.

Further, the etching device 200 may also include a liquid introducing apparatus (not shown in the figure), and the liquid introducing apparatus is used for introducing the etching liquid into the hollow structure of the porous roller 210 through at least one opening of the openings at both ends of the porous roller 210.

Optionally, the liquid introducing apparatus may transfer the etching liquid into the porous roller 210 before the etching device 200 is operated.

The etching liquid may be consumed during the process of etching the metal layer 230, such as liquid leakage, and therefore, the liquid introducing apparatus may also transfer the etching liquid into the porous roller 210 during the operation of the etching device 200.

So as to save the etching liquid, and thereby achieving the objective of reducing the cost of preparing openings of the current collector. In the embodiment of the present application, the liquid introducing apparatus may be connected to the liquid collecting apparatus 240, so that the etching liquid collected by the liquid collecting apparatus 240 may be transmitted to the liquid introducing apparatus, and the liquid introducing apparatus may then transfer the etching liquid obtained from the liquid collecting apparatus 240 into the hollow structure of the porous roller 210.

In this way, recycling of the etching liquid is capable of being achieved, thereby reducing the cost of preparing the openings of the current collector.

Optionally, the liquid introducing apparatus may be, but is not limited to, a pump.

Although the present application has been described with reference to the preferred embodiments, various improvements can be made thereto and components thereof can be replaced with equivalents without departing from the scope of the present application. In particular, the technical features mentioned in the various embodiments can be combined in any manner as long as there is no structural conflict. The present application is not limited to the specific embodiments disclosed herein, but rather includes all technical solutions falling within the scope of the claims.

What is claimed is:

1. A roll-to-roll etching device for etching a current collector, the current collector comprising a plastic film and a to-be-etched metal layer disposed on one surface of the plastic film, the etching device comprising:

a porous roller, wherein the porous roller is a hollow structure with two end openings at both ends, an etching liquid is accommodated in the hollow structure, and an outer surface of the porous roller is provided with a plurality of openings;

at least one pressing roller, attached to the porous roller and arranged above a liquid level of the etching liquid in the hollow structure, and used for pressing and attaching the metal layer onto the outer surface of the porous roller;

a liquid collecting container, wherein at least part of the porous roller is arranged in the liquid collecting container;

a liquid introducing apparatus connected to the liquid collecting tank used for introducing the etching liquid into the hollow structure through at least one end opening of the two end openings at both ends of the porous roller;

a cleaning apparatus, arranged downstream in a conveying direction of the metal layer of the porous roller, wherein the cleaning apparatus comprises a washing tank, a transmission roller, and a cleaning liquid arranged in the washing tank, wherein the transmission roller is merged or submerged in the cleaning liquid and used to convey the metal layer into the washing tank, the cleaning liquid is used to clean off residual etching liquid on the metal layer, wherein during rotation of the porous roller, the etching liquid is continuously supplied into the hollow structure and passes under pressure from within the hollow structure through at least part of the openings of the plurality of openings to continuously soak the metal layer in contact with the at least part of the openings, so as to continuously etch the metal layer in contact with the at least part of the openings to form a plurality of openings on the surface of the metal layer, each opening of the plurality of openings on the porous roller correspond to each opening of the openings on the metal layer, and the liquid collecting apparatus is used for collecting the etching liquid leaked from the porous roller so as to avoid contamination by the etching liquid, the liquid introducing apparatus is connected to the liquid collecting tank and capable of transferring the etching liquid collected in the liquid collecting tank to the liquid introducing apparatus to recycle the etching liquid.

2. The etching device according to claim 1, wherein the at least one pressing roller is arranged above an axis of the porous roller.

3. The etching device according to claim 1, wherein a quantity of the at least one pressing roller is two, and the two pressing rollers are respectively arranged upstream and downstream in a conveying direction of the metal layer attached to the porous roller; and starting from the pressing roller arranged upstream in the conveying direction to the pressing roller arranged downstream in the conveying direction, the etching liquid continuously etches the metal layer in contact with the at least part of the openings.

4. The etching device according to claim 1, further comprising:

a drying apparatus, arranged downstream in the conveying direction of the metal layer of the cleaning apparatus, and used for drying the metal layer after the cleaning apparatus cleans the residual etching liquid on the metal layer.

5. The etching device according to claim 4, wherein the drying apparatus comprises at least one of a heating tube, a UV lamp, and an air knife.

6. The etching device according to claim 5, wherein the drying apparatus comprises at least one air knife, and the at least one air knife is used for air-drying the metal layer after the metal layer is cleaned by the cleaning apparatus.

7. The etching device according to claim 1, further comprising:

a conveying roller, used for conveying the metal layer to the porous roller and the pressing roller in the conveying direction of the metal layer, and conveying the metal layer away from the porous roller and the pressing roller after the metal layer is etched.

8. The etching device according to claim 1, wherein a proportion of the openings formed on the surface of the metal layer is 30% to 50%.

9. The etching device according to claim 1, wherein the plastic film is selected from oriented polypropylene (OPP) film, polyimide (PI) film, polyethylene glycol terephthalate (PET) film, cast polypropylene (CPP) film, and polyvinyl chloride (PVC) film.

10. The etching device according to claim 1, wherein, the current collector is a positive electrode current collector, and the metal layer is aluminum foil, or the current collector is a negative electrode current collector, and the metal layer is copper foil.

11. The etching device according to claim 1, wherein an etching time of metal layer soaked in the etching liquid is 30 second, the conveying speed of the metal layer is 1 meter per minute to 5 meters per minute, and an etching depth of openings created on the surface of the metal layer is 50 μm to 100 μm.

12. The etching device according to claim 1, wherein the etching liquid is an acidic copper chloride or a solution of ammonium persulfate.

13. The etching device according to claim 1, wherein the cleaning apparatus further comprises at least one spray pipe, the at least one spray pipe accommodates a cleaning fluid and is used for spraying the cleaning fluid to the etched metal layer to clean off the residual etching liquid on the metal layer.

* * * * *